US006606944B1

(12) United States Patent
Athans et al.

(10) Patent No.: US 6,606,944 B1
(45) Date of Patent: Aug. 19, 2003

(54) DEVICE AND METHOD FOR DETERMINING A SIGNATURE LAP

(75) Inventors: George Athans, Lee, NH (US); Christian Heinz Miescher, Newburgport, MA (US); Leon Christopher Cote, Newmarket, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 148 days.

(21) Appl. No.: 09/715,591

(22) Filed: Nov. 17, 2000

(51) Int. Cl.[7] ..... B31B 1/00

(52) U.S. Cl. ..... 101/224; 493/23; 493/426; 493/476

(58) Field of Search ..... 493/23, 34, 19, 493/476, 434, 442, 425, 417, 426, 357, 427, 441, 397; 412/14, 22; 270/20.1, 21.1; 101/224, 227

(56) References Cited

U.S. PATENT DOCUMENTS

| | | | | | |
|---|---|---|---|---|---|
| 2,031,780 | A | * | 2/1936 | Lamatsch | 493/360 |
| 4,578,052 | A | * | 3/1986 | Engel et al. | 493/11 |
| 5,571,069 | A | * | 11/1996 | Shah | 493/357 |
| 6,024,682 | A | * | 2/2000 | Mandel et al. | 493/23 |
| 6,093,139 | A | * | 7/2000 | Belanger | 493/353 |
| 6,165,118 | A | * | 12/2000 | Eckert | 493/425 |
| 6,279,890 | B1 | * | 8/2001 | Tomczak | 101/227 |
| 6,331,154 | B1 | * | 12/2001 | Shibuya et al. | 493/424 |

FOREIGN PATENT DOCUMENTS

| | | |
|---|---|---|
| JP | 62-70174 | 3/1987 |
| JP | 6-255881 | 9/1994 |

OTHER PUBLICATIONS

Braasch, William, *Newspaper Presses*, (1958), pp. 136–154, Ch. 6.

* cited by examiner

*Primary Examiner*—Leslie J. Evanisko
*Assistant Examiner*—Kevin D Williams
(74) *Attorney, Agent, or Firm*—Davidson, Davidson & Kappel, LLC

(57) ABSTRACT

A folder system includes an adjustable-lap folder for folding signatures so-as to define folded signatures, an optical sensor for measuring a presence of the fold&ed signatures, and a controller connected to the rotary blade folder and the optical sensor for determining a lap of the folded signatures. Also provided is a method for folding signatures comprising folding signatures in a folder so as to define folded signatures, and measuring with an optical sensor the edges of the folded signatures so as to determine a lap.

8 Claims, 2 Drawing Sheets

DEVICE AND METHOD FOR DETERMINING A SIGNATURE LAP

BACKGROUND OF THE INVENTION

1. Field of the Invention

The present invention relates generally to printing presses and more particularly to a device and method for setting a lap on the folded signature.

2. Background Information

Web printing presses print a continuous web of material, such as paper. In a folder of the printing press, the continuous web then is cut into signatures in a cutting unit and folded.

One way to fold the resulting signatures is using a rotary blade folder, which includes a cylinder with rotary blades which selectively extend beyond the circumference of the cylinder to provide a fold to the signature. The signature is held at a lead edge by pins, and folded, usually near the middle of the signature by a fold blade. The fold is forced by the blade toward two rotating folding rollers located beside the cylinder, which grip the signature along the fold at a nip, set the fold and deliver the folded product, for example, to a fan unit. Chapter 6 (pages 136 to 154) of the book "Newspaper Presses" by William Braasch, for example, describes rotary blade folders.

If the signature is folded perfectly in half, no lap, which is the distance between the front and lead edges of the signature, results. However, if the signature is folded off-center a lap results, since the front and lead edges are spaced apart.

With rotary blade folders, the lap changes when the speed of the machine changes. Thus during slower a pre-production test run, the lap will be different than during a full speed production run. Proper measurement adjustment of the lap in the rotary blade folder while the folder is running thus is important.

The lap of the signature may be adjusted by moving the blades circumferentially with respect to the pins. The distance between the pin and lead edge of the signature and the location where the rotary blade forces the signature into the folding unit determines the lap.

The abstract of Japanese Patent Application No. 62-70174 purports to disclose a helical gear mechanism to adjust the lap quantity of folded sheets without stopping the machine. Separately formed needle segments and folding edge segments are provided in turn on a folding barrel. The needle side helical gears are shifted in an axial by a rotating drive mechanism.

The device of the abstract of Japanese Patent Application No. 62-70174 appears not have a controller unit for directing the lap adjustment mechanism and the device seems incapable of self-correcting the lap. Moreover, no optical sensor and no feedback mechanism to sense a lap appear to be present.

The abstract of Japanese Patent Application No. 6-255881 purports to disclose a lap adjusting data corresponding to each rotary press speed of each longitudinal page that is fed as a command signal to an operating motor of a control unit. A deviation of a motor rotational speed detection signal from the above command signal is fed as a command signal to the operating motor and the rotational speed is controlled until a lap is obtained within a permissible range.

The device of Japanese Patent Application No. 6-255881 has the disadvantage that no sensors appear to be present to automatically detect the lap on a folded signature. Thus, although the device appears capable of adjusting the lap on a folded signature pursuant to command signals, the device appears not to have a feedback mechanism capable of checking the actual lap on a folded signature.

BRIEF SUMMARY OF THE INVENTION

An object of the present invention is to provide for a device and method for measuring and controlling a lap on folded signatures. An additional or alternative object of the present invention is to provide an optical sensor and a controller for measuring and setting a lap on the folded signatures. Yet another additional or alternative object of the present invention is to provide an automatic feedback mechanism to automatically adjust the lap on the folded signatures.

The present invention provides a folder system comprising an adjustable-lap folder for folding signatures so as to form folded signatures, an optical sensor for measuring a lap on the folded signatures, and a controller connected to the folder and the optical sensor for adjusting the lap.

Preferably, the adjustable-lap folder is a rotary blade folder having folding rolls for accepting the signatures so as to form folded signatures.

The rotary blade folder may further include an outer pin shell circumferentially movable with respect to blades of the rotary blade folder. The outer pin shell provides the advantage of automated adjustment of the location of the signature with respect to the folding blades so that the location of the fold may be changed.

The optical sensor may sense the first edge (the folded edge) of the folded signature to send a signal to the controller when the folded edge passes the optical sensor. When the folded edge of the folded signature passes the sensor, the optical sensor is triggered. The sensor may be triggered by a break in an electromagnetic beam that emanates from the optical sensor. When the beam connects again, the last edge (either the trail or lead edge of the signature) is detected. Hence, the amount of time, t, that it takes for the entire signature to pass the optical sensor is known. The triggering of the optical sensor provides the advantage of automatic and efficient data accumulation, which may be used in calculating the lap of the folded signature.

Preferably, the controller has a processor to receive the velocity of the folded signature and to receive the signals sent by the optical sensor to determine a length of the folded signature, s. When the optical sensor is triggered, the optical sensor sends a signal to the controller. Hence, an amount of time, t, necessary for the folded signature to pass may be calculated. For example, the controller could start an internal timer after receiving the first signal and stop the timer after receiving a second signal. The amount of time, t, is multiplied by the velocity, v, of the signature, which is a predetermined constant, to give the length, s, of the signature, $s=t*v$. The velocity may be determined by the rate of rotation of the folding rolls.

Preferably, the processor uses the length, s, of the folded signature and a cutoff size of the signature, c, to calculate the lap of the folded signature, D. To calculate the lap of the folded signature, D, the length of the signature, s, is multiplied by two, from this quantity the length of the cutoff, c, is subtracted, $D=(s*2)-c$. The cutoff, c, is the length of the entire paper and is determined from the size of the signatures cut by a cutting cylinder from a web. The calculation provides the advantage of automatically determining the correct lap on the folded signature without the need for an operator to measure the lap.

Preferably, the processor may compute whether the lap is positive or negative, i.e., the lap sign, based on a lap of a subsequent folded signature and the previously computed lap. The computation provides the advantage of determining the lap sign without the need for the machine to be stopped or an operator to be present. Moreover, the data obtained may be used to automatically adjust the device to accord with an operator specified lap distance.

The lap sign determination may be performed by comparing the lap on a primary folded signature to the lap on the subsequent folded signature. The absolute value of the primary lap is first determined and the controller then sends a control signal to circumferentially move the outer pin shell a small distance with respect to the folding blade shell, e.g., by increasing the distance between the pin and the folding blade for one signature. The outer pin shell thus rotates circumferentially with respect to the pin shell a small distance, preferably so that the difference between the primary lap and a subsequent lap is equal to the minimum distance that the optical sensor is able to record, but in any event less than the primary lap. If the lap of the primary signature is positive, the increase in distance between the pin and the folding blade will decrease the lap of the subsequent signature. If the lap of the primary signature is negative, the increase in distance will increase the absolute value of the lap of the signature. The sign of the lap of the primary signature thus can be determined. It should be noted that the lap on the primary signature could also be zero, in which case a sign determination is not necessary.

As an example, if the outer pin shell circumferentially rotates with respect to the blade shell, e.g., clock-wise, to increase the distance between a pin and the folding blade, the controller may then compare the subsequent lap $D^2$ with the primary lap $D^1$ to determine the sign of the primary signature. If the difference between the primary lap $D^1$ and the subsequent lap $D^2$ is a positive number, i.e., $D^1-D^2>0$, the primary signature has a positive lap sign. Conversely, if the difference between the primary lap $D^1$ and the subsequent lap $D^2$ is a negative number, i.e., $D^1-D^2<0$, the primary signature has a negative lap sign.

The outer pin shell could just as easily be rotated circumferentially with respect to the folding blade shell so as to decrease the distance between the pin and the blade, e.g., counter-clock-wise. The controller may then compare the subsequent lap $D^2$ with the primary lap $D^1$ to determine the inclination of the primary signature. If the difference between the primary lap $D^1$, and the subsequent lap $D^2$, is a negative number, i.e., $D^1-D^2<0$, the primary signature has a positive lap sign. Conversely, if the difference between the primary lap $D^1$ and the subsequent lap $D^2$ is a positive number, i.e., $D^1-D^2>0$, the primary signature has a negative lap sign.

Preferably, the controller has an automatic feedback capability to use the lap data and positive or negative signature inclination data to automatically configure the lap on the folded signature pursuant to an user specified lap. Setting of the lap is accomplished by moving the outer pin shell in relation to the folding blades depending on a control signal sent by the controller. In order to determine the correct control signal, the controller determines the sign (if not already known) of the folded signature and then compares the lap on the folded signature to a desired lap entered prior by an operator. The comparison provides the advantage of automatic adjustment of the lap on the folded signatures to accord with an user specified lap without stopping of the folder.

The feedback control can be performed by comparing the primary lap $D^1$ with a desired lap $x_1$ input by the operator. The desired lap $x_1$ may be a positive, negative, or zero value.

The controller then makes a determination of whether the primary signature has a positive or negative sign, or zero, and moves the outer pin shell the desired amount by circumferentially rotating the pin shell with respect to the blade shell.

When the primary signature has a positive lap sign, if the primary lap $D^1$ is greater than the desired lap $x_1$, the control unit sends a control signal that causes the outer pin shell to circumferentially move so that the distance between the pin and the folding blade increases. However, if the primary lap $D^1$ is less than the desired lap $x_1$, the control unit sends a control signal that causes the outer pin shell to circumferentially move so that the distance between the pin and the folding blade decreases.

Preferably, the folding cylinder includes at least one pin attached to an outer pin shell to hold the lead edge of the signature.

Preferably, the rotary blade folder may further comprise a cutting cylinder and an anvil attached to the outer pin shell to aid in cutting the web.

The present invention provides a method for folding signatures comprising cutting a web with an adjustable-lap folder so as to form signatures; folding the signatures using the folder so as to form folded signatures; measuring optically a lap in the folded signatures; and adjusting the lap as a function of the measuring step.

The folding step may further include pinning a lead edge of a signature and contacting the signature at a set distance from the lead edge with a folding blade. By pinning the lead edge and contacting the signature a set distance from the lead edge, the signature is stabilized and the lap distance may be determined.

Preferably, the method for folding signatures may include measuring a velocity of the folded signatures. The velocity measurement allows the lap distance to be determined if the speed of the rotary blade folder is changed.

Preferably, the method for folding signatures may further include altering the set distance so as to change the lap. The advantage provided by changing the set distance is that the lap distance of a signature may be changed.

The step of altering the distance may preferably include altering the set distance by using a feedback from a controller. By using the feedback from the controller, the advantage of automatic calibration of the lap distance is provided.

BRIEF DESCRIPTION OF THE DRAWINGS

A preferred embodiment of the present invention is described below by reference to the following drawings, in which.

DETAILED DESCRIPTION

Figure 1:
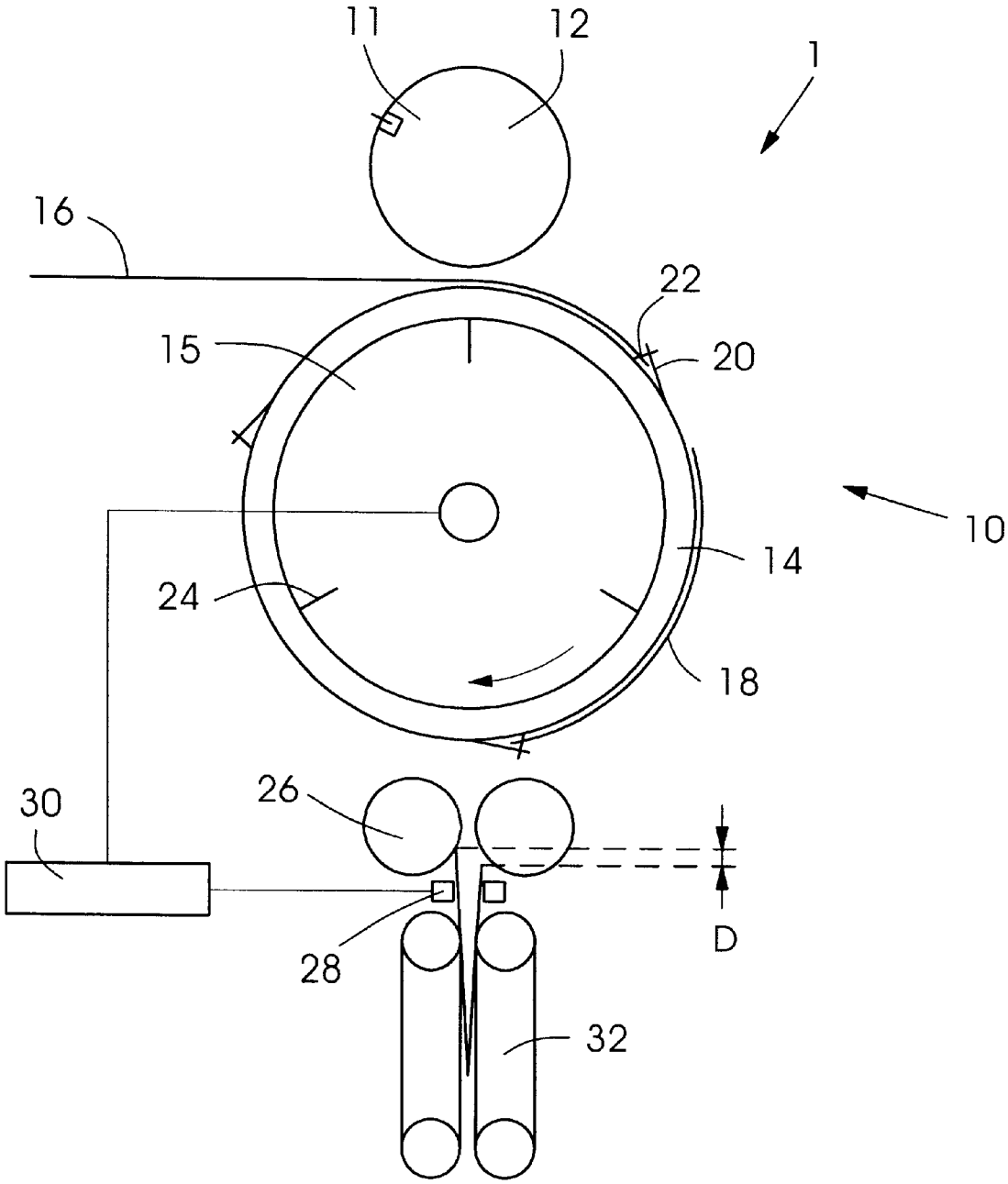
FIG. 1 shows a side view of a rotary blade folder system.

FIG. 1 shows a side view of a preferred embodiment of the present invention using a rotary blade folder system I having an adjustable-lap folder 10. A web 16 enters folder 10, which has a cutting cylinder 12 and an outer pin shell 14, which is driven by and circumferentially movable with respect to a rotating folding blade shell The cutting cylinder 12 contains a cutting unit 11, e.g., a knife, which acts in unison with an anvil 20 attached to the outer pin shell 14 to cut the web into an at least one signature 18. A pin 22 attached to the outer pin shell 14 holds a lead edge of the signature 18 and orientates the signature 18 with respect to one of a plurality of folding blades 24, located on the folding blade shell 15. As the signature 18 rotates a certain distance with the cylinder having shell 14 and shell 15, the folding blade 24 provides a fold and pushes the signature 18 into the grip of a plurality of folding rolls 26 which work in conjunction to set the fold and deliver the folded signature 18 to a plurality of transport belts 32. While in route to the transport belts 32, the folded signature 18 passes an optical sensor 28, which may include a light transmitter and a light receiver. The optical sensor 28 detects when an edge of the folded signature 18 passes, e.g., the passing interrupts an electromagnetic beam emanating from the optical sensor 28, and sends a signal to a controller 30. The controller 30 uses the signal sent from the optical sensor 28 to perform calculations, as explained with respect to FIG. 2 below. If the data sent to the controller 30 is inconsistent with data specified by an operator, the controller 30 sends a control signal to modify the location of the folding blade 24 with respect to the signature 18, i.e., provides feedback, as will be explained with respect to FIG. 3. FIG. 1 also shows a folded signature with a negative lap D.

Figure 2:
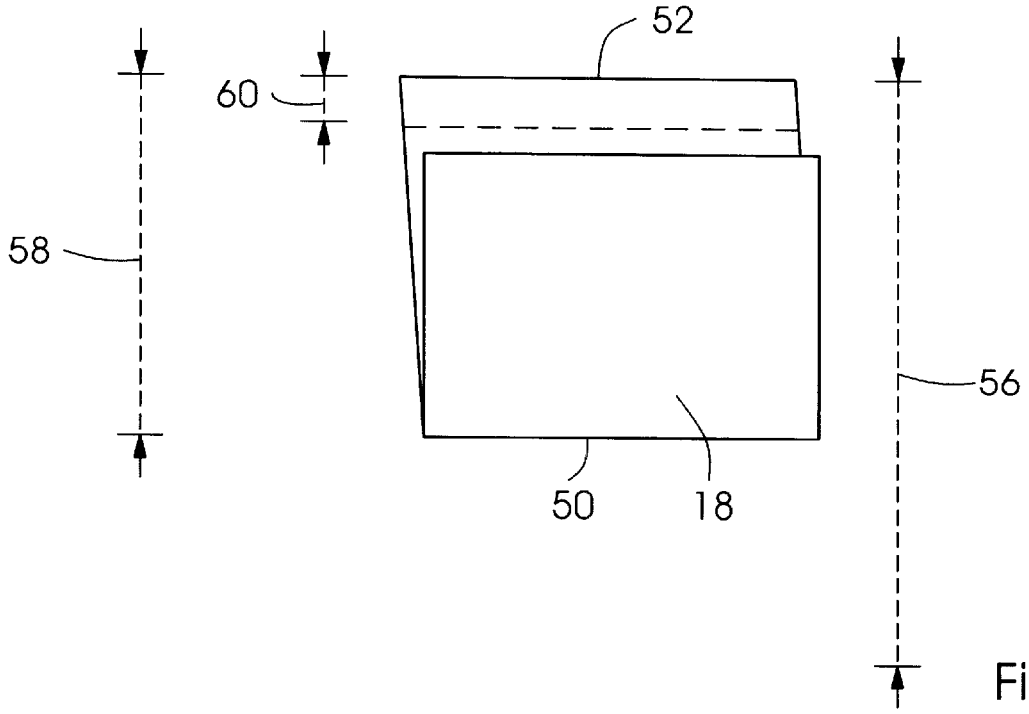
FIG. 2 shows a side view of the folded signature.

FIG. 2 shows a side view of the folded signature 18. When the optical sensor 28 detects the passing of a folded edge 50, an electromagnetic beam emanating from the optical sensor 28 is interrupted, the optical sensor 28 sends a signal to the controller 30. The controller 30 starts an internal timing mechanism after receiving a first signal and stops the internal timing mechanism after receiving a second signal when the beam again is received or uninterrupted, i.e., when a last edge 52 of the signature passes the sensor 28. Thus, the controller 30 calculates the time, t, for the folded signature 18 to pass the optical sensor. The controller 30 then multiplies the time, t, by the velocity, v, of the folded signature 18 to calculate a folded length, s 58, of the signature 18; hence, $s=t*v$. The velocity v may be determined by the rotational velocity of the folding rolls 26, and input into the controller 30 by the operator, or may be determined in another manner desired. The controller 30 calculates a lap (D) 60, by multiplying the folded length (s) 58 of the signature 18 by the number 2 and then subtracting a cutoff distance (c) 56; thus, $D=(s*2)-c$. The cutoff distance c 56, is the entire length of the folded signature 18 and is determined by the speed of the cutting cylinder 11 or in any other manner, for example, by being input by the operator.

Figure 3:
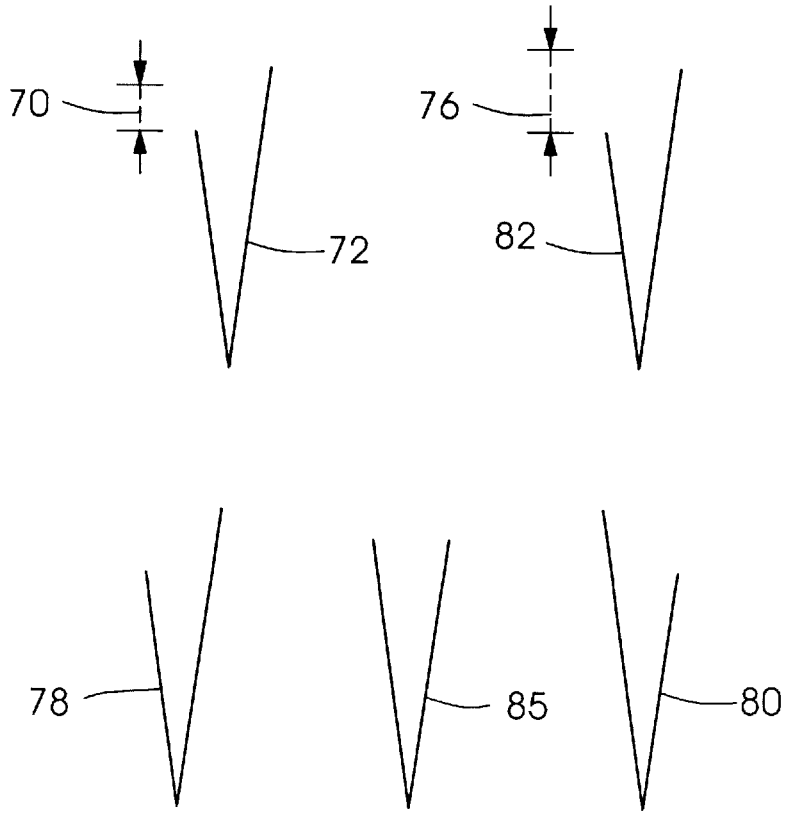
FIG. 3 shows a side view of various folded signatures.

FIG. 3 shows a side view of signatures to better explain the lap sign determination process of the present invention. A controller 30 (FIG. 1) may receive data regarding a positive primary lap 70 on a positive lap primary signature 72.

Since the primary lap 70 is not zero, the controller 30 sends a control signal to move the outer pin shell 14 a distance circumferentially with respect to the blade shell 15, so that the difference between the primary lap 70 and a subsequent lap 76 is equal at least to a minimum distance that the optical sensor is able to record and is less than the primary lap 70. The movement, for example, intentionally decreases the distance between the pin 22 and the blade 24. The controller 30 may then compare the subsequent lap 76, $D^2$, with the primary lap 70, $D^1$ to determine the lap sign of the primary signature 72. Since the difference between the primary lap 70, $D^1$, and the subsequent lap 76, $D^2$, is a negative number, i.e., 76 is greater than 70, the primary signature 72 has a positive sign. Conversely, if the primary lap 70, $D^1$, had been negative, the subsequent lap 76, $D^2$, would have been less than the primary lap 70. If there is no difference between the primary lap 70, $D^1$, and the subsequent lap 76, $D^2$, an error has occurred and the controller 30 sends an error signal to alert the operator.

Also shown in FIG. 3 are a positive sign lap signature 78, a zero sign lap signature 85 and a negative sign lap signature 80.

An operator can adjust the lap between these positions by altering a distance between the pin 22 and the blade 24 by moving the pin shell 14 circumferentially with respect to blade shell 15. If the pin shell 14 is moved faster than the blade shell 15, the distance between pin 22 and blade 24 for a signature increases and the lap becomes increasingly negative, so that a positive lap becomes smaller and a negative lap becomes larger in absolute terms. A zero lap also would become negative, i.e., from a signature similar to signature 85 to a signature similar to signature 80. If pin shell 14 is moved more slowly than blade shell 15, the lap becomes increasingly positive.

The operator thus can set a desired lap, positive or negative, at controller 30 and the feedback thus would move the pin shell with respect to the blade shell until the desired lap was achieved, at which time the controller ensures that the blade shell 15 and the pin shell 14 rotate at a same speed.

"Optical sensor" as defined herein can include any type of radiation-based sensor, for example using radio wave, infrared, ultraviolet or visible light beams.

What is claimed is:

1. A folder system comprising:

an adjustable-lap folder for folding signatures so as to define folded signatures, the adjustable lap folder being a rotary blade folder having a pin shell and a blade shell with at least one folding blade;

an optical sensor for detecting a presence of the folded signatures, the optical sensor having an output; and a controller connected to the folder and the optical sensor for determining a lap of the folded signatures;

the controller including a processor for detecting a folded edge and a last edge of the folded signatures, the controller moving the pin shell with respect to the blade shell as a function of the output.

2. The folder system as recited in claim 1 wherein the folder includes a pair of folding rolls.

3. The folder system as recited in claim 1 wherein the controller includes a processor for calculating a length of the folded signatures.

4. The folder system as recited in claim 1 wherein the controller includes a processor for calculating a lap sign.

5. The folder system as recited in claim 1 wherein the controller controls a lap of the folder.

6. The folder system as recited in claim 1 wherein the folder includes a cutting device and an anvil attached to the pin shell to aid in cutting the web through interaction with the cutting device.

7. A method for folding signatures comprising:

folding signatures in a folder so as to define folded signatures, said folder having a pin shell and a blade shell, the folding step including pinning a lead edge of a signature and contacting the signature at a set distance from the lead edge with a folding blade;

measurement to a controller; and detecting with an optical sensor edges of the folded signatures so as to determine a lap measurement;

blade shell to alter the set distance between the lead edge and the folding blade so as to change the lap using a feedback from said controller.

8. The method as recited in claim 7 further including measuring a velocity of the folded signatures.

* * * * *

UNITED STATES PATENT AND TRADEMARK OFFICE

CERTIFICATE OF CORRECTION

PATENT NO. : 6,606,944 B1 
DATED : August 19, 2003
INVENTOR(S) : Athans et al.

It is certified that error appears in the above-identified patent and that said Letters Patent is hereby corrected as shown below:

Column 6,
Lines 58 to 63,
"measurement to a controller; and detecting with an optical sensor edges of the folded signatures so as to determine a lap measurement;
blade shell to alter the set distance between the lead edge and the folding blade so as to change the lap using a feedback from said controller."

should read

-- detecting with an optical sensor edges of the folded signatures so as to determine a lap measurement
outputting said lap measurement to a controller; and
moving the pin shell with respect to the blade shell to alter distance between the lead edge and the folding blade so as to change the lap using a feedback from said controller. --

Signed and Sealed this

Ninth Day of March, 2004

JON W. DUDAS
*Acting Director of the United States Patent and Trademark Office*